US009976362B2

(12) United States Patent
Rahim et al.

(10) Patent No.: US 9,976,362 B2
(45) Date of Patent: May 22, 2018

(54) LIFTING DEVICE AND METHOD

(71) Applicants: Shazam Rahim, Broussard, LA (US); Steven Dale Ables, Keithville, LA (US)

(72) Inventors: Shazam Rahim, Broussard, LA (US); Steven Dale Ables, Keithville, LA (US)

(73) Assignee: SHAZAM RAHIM, Broussard, LA (US)

( * ) Notice: Subject to any disclaimer, the term of this patent is extended or adjusted under 35 U.S.C. 154(b) by 163 days.

(21) Appl. No.: 15/072,115

(22) Filed: Mar. 16, 2016

(65) Prior Publication Data

US 2016/0273295 A1 Sep. 22, 2016

Related U.S. Application Data

(60) Provisional application No. 62/134,046, filed on Mar. 17, 2015.

(51) Int. Cl.
*E21B 19/00* (2006.01)
*E21B 33/02* (2006.01)

(52) U.S. Cl.
CPC ..... *E21B 19/00* (2013.01); *E21B 33/02* (2013.01)

(58) Field of Classification Search
CPC ..... E21B 19/00; E21B 33/02
See application file for complete search history.

(56) References Cited

U.S. PATENT DOCUMENTS 1,664,593 A 4/1928 Coffman
4,442,892 A * 4/1984 Delesandri ..... E21B 19/00 137/315.02

(Continued)

OTHER PUBLICATIONS

International Search Report and Written Opinion of the International Searching Authority issued in Applicant's counterpart International Patent Application No. PCT/US2016/022868.

*Primary Examiner* — Brad Harcourt
(74) *Attorney, Agent, or Firm* — Jones Walker LLP

(57) ABSTRACT

A hydraulic lifting apparatus and a method is described that raises and lowers caps, such as night caps, lift caps, and other similar items, about a cap sub engaged to a wellhead. The apparatus includes a cap sub, vertical support member, a horizontal support member, a base member, and a hydraulic cylinder. The lifting device is attached to a wellhead assembly through a cap sub. The base member is attached to the cap sub through an enlarged ring. The base member also includes an elongated projected portion. The vertical support member is rotatably retained within a bore in the elongated projected portion. The proximal end of horizontal support member is connected to the upper end of the vertical support member. The hydraulic cylinder, which includes a hydraulic head and a hydraulic piston, is connected to the distal end of the horizontal support member. The vertical support member is capable of being rotated about the base member. The hydraulic cylinder is actuated to raise or lower a cap onto a cap sub, which is removably attached to a wellhead assembly. The vertical support member may be locked into place in a cap-engagement position or a non-cap engagement position through use of a spring-loaded locking pin which is inserted into a locking bracket on the vertical support member and into a recess on the base member.

19 Claims, 8 Drawing Sheets

(56) References Cited

U.S. PATENT DOCUMENTS

| | | | | |
|---|---|---|---|---|
| 6,189,620 | B1 | 2/2001 | McDowell | |
| 6,234,253 | B1 | 5/2001 | Dallas | |
| 7,096,963 | B2 | 8/2006 | Moncus et al. | |
| 7,341,109 | B1 * | 3/2008 | McDowell | E21B 19/16 166/379 |
| 2011/0048735 | A1 | 3/2011 | Fuss et al. | |
| 2011/0214917 | A1 | 9/2011 | Boudreaux | |

* cited by examiner

LIFTING DEVICE AND METHOD

CROSS-REFERENCE TO RELATED APPLICATION

This application claims the benefit of and priority to U.S. Provisional Patent Application No. 62/134,046, filed on Mar. 17, 2015, which is fully incorporated herein by reference.

FIELD OF THE INVENTION

The present invention relates to a cap lifting apparatus and method for raising or lowering of caps, such as night caps, lift caps, and other similar items, about a cap sub engaged to a wellhead.

BACKGROUND OF THE INVENTION

Night caps are placed on wellheads to protect the well from debris falling into the well when the well is not in use. Night caps also prevent blow outs when the well is not in use. Lift caps are used for lifting drill tools from the well and out of the wellhead. In operation, the lift cap is placed onto one end of the drill tool and then the drill tool is lowered into the well hole. Alternatively, the lift cap may be attached to a drill tool that is already in the well hole and used to remove the drill tool from the well hole.

SUMMARY OF THE INVENTION

The lifting apparatus may be used for lifting loads above a wellhead through use of a hydraulic pump and hydraulic cylinder. The load may be a lift cap or night cap. The lifting apparatus may be used to lower the load onto the wellhead or the stack on top of a wellhead. For example, the lifting apparatus can be used to lower a night cap onto a wellhead or the stack on top of the wellhead when the wellhead is not in use. The lifting apparatus may also be used to lift the night cap off the wellhead or the stack on top of the wellhead when the wellhead is ready for use. The lifting apparatus may be rotated so that the load is positioned above the wellhead before lowering. The lifting apparatus may be rotated so that the load is positioned 180 degrees away from the wellhead when the load is not in use.

In one embodiment, the cap lifting apparatus comprises a frame assembly including a base member, a vertical support member having an upper end and a lower end, and a horizontal support member having a distal end and a proximal end. The base member includes an enlarged ring portion that is configured to receive a cap sub which is operatively attached to a wellhead. The base member also includes an elongated projected portion that has a bore that may rotatably receive the lower end of the vertical support member. The proximal end of the horizontal support member may be operatively connected to the upper end of the vertical support member. The cap lifting apparatus also includes a hydraulic cylinder. The hydraulic cylinder has an upper end and a lower end. The hydraulic cylinder also has a hydraulic piston. A piston head is contained within the hydraulic cylinder. A piston rod is connected to the piston head and extends from the lower end of the hydraulic cylinder for operative attachment to a cap. In operation, actuation of the hydraulic piston causes the cap to raise or lower about the cap sub.

In another embodiment, the enlarged ring portion of the base member further includes a first aperture. The first aperture is configured to receive a first locking screw, which facilitates the operative attachment of the base member to the cap sub.

In yet another embodiment, the enlarged ring portion of the base member also includes a second aperture. The second aperture is configured to receive a second locking screw, which facilitates the operative attachment of the base member to the cap sub.

In one embodiment, the bore located in the elongated projected portion of the base member has an inner bore wall. The inner bore wall may have a profile.

In another embodiment, the profile of the inner bore wall includes an upper bearing shoulder and a lower bearing shoulder. An upper bearing means may be accommodated on the upper bearing shoulder and a lower bearing means may be accommodated on the lower bearing shoulder.

In still another embodiment, the profile of the inner bore wall includes an upper seal shoulder and a lower seal shoulder. An upper seal means may be accommodated on the upper seal shoulder and a lower seal means may be accommodated on the lower seal shoulder.

In yet another embodiment, the lower end of the vertical support member extends through the inner bore wall and below the elongated projected portion of the base member. The vertical support member is also rotatably affixed to the base member by a retainer washer and a hex nut. The retainer washer is positioned between the vertical support member and the lower seal means. The hex nut is affixed to the lower end of the vertical support member that extends below the elongated projection of the base member.

In one embodiment, the cap lifting apparatus includes a locking pin bracket affixed to the vertical support member. A spring-loaded locking pin is operatively positioned about the locking pin bracket. The elongated projected portion of the base member also includes a first recess and a second recess. Each recess is dimensioned to receive the spring-loaded locking pin when the spring-loaded locking pin is actuated.

In another embodiment, the spring-loaded locking pin engages the first recess when the vertical support member is rotated to a cap engagement position. In the cap engagement position, the cap is capable of being raised or lowered about the cap sub. The spring-loaded locking pin engages the second recess when the vertical support member is rotated to a non-cap engagement position.

In yet another embodiment, when the vertical support member is rotated to the non-cap engagement position, the vertical support member is about 180 degrees from the cap-engagement position.

In one embodiment, the horizontal support member includes a through-hole. A first shackle may be positioned in the through-hole to affix the first shackle to the horizontal support member. Additionally, a second shackle may be operatively affixed to the cap. A ring may interconnect the piston rod and the second shackle. And a safety line, which has a first end and second end, is connected to the first shackle and the ring. The first end of the safety line is connected to the first shackle and the second end of the safety line is connected to the ring In one embodiment, the cap is a lifting cap, a night cap, or a load device.

In an embodiment, a cap lifting apparatus includes a well head assembly, a frame assembly, a hydraulic cylinder, a cap, and a safety line. The wellhead assembly includes a cap sub, a thread thru nut, a split ring, and a wellhead. Cap sub has an upper section and a lower section. Thread thru nut has an upper section, a lower section, and internal threads. The wellhead is threadably attached to the lower section of the thread thru nut and the lower section of the cap sub member is positioned in the upper section of the thread thru nut. The split ring is threadedly connected to the upper section of the thread thru nut and positioned between the thread thru nut and the cap sub. The frame assembly includes a base member, a vertical support member, and a horizontal support member. The vertical support member has an upper end and a lower end. The horizontal support member has a distal end and a proximal end. Additionally, the base member includes an enlarged ring portion, which operatively receives the cap sub, and an elongated projected portion, which includes a machined bore. The machined bore rotatably receives the lower end of the vertical support member. The proximal end of the horizontal support member is operatively connected to the upper end of the vertical support member. The hydraulic cylinder includes an upper end, a lower end, and a hydraulic piston. The hydraulic piston includes a piston head, which is contained within the hydraulic cylinder, and a piston rod, which is connected to the piston head. The piston rod extends from the lower end of the hydraulic cylinder. The cap is operatively attached to the piston head so that actuation of the hydraulic piston causes the cap to be raised or lowered about the cap sub. The horizontal member also includes a through-hole. A first shackle is operatively affixed to the through-hole in the horizontal support member. A second shackle is operatively affixed to the cap. A ring interconnects the piston rod and the second shackle. Additionally, a safety line, which has a first end and a second end, connects the first shackle to the ring. The first end of the safety line is connected to the first shackle and the second end of the safety line is connected to the ring.

In another embodiment, the enlarged ring portion of the base member includes a first aperture and a second aperture. The first aperture receives a first locking screw for operative attachment of the base member to the cap sub. The second aperture receives a second locking screw for operative attachment of the base member to the cap sub. Additionally, the outer surface of the cap sub includes a circumferential groove to receive the first and second locking screws.

In yet another embodiment, the bore of the elongated projected portion of the base member is defined by an inner bore wall with a profile. The profile of the inner bore wall includes an upper bearing shoulder and a lower bearing shoulder. An upper bearing means is accommodated on the upper bearing shoulder. A lower bearing means is accommodated on the lower bearing shoulder. The profile of the inner bore wall also includes an upper seal shoulder and a lower seal shoulder. An upper seal means is accommodated on the upper seal shoulder and a lower seal means is accommodated on the lower seal shoulder.

In yet another embodiment, the lower end of the vertical support member extends through the inner bore wall and below the elongated projected portion of the base member. Additionally, the vertical support member is rotatably affixed to the base member by a retainer washer and a hex nut. The retainer washer is positioned between the vertical support member and the lower seal means. The hex nut is affixed to the lower end of the vertical support member that extends below the elongated projection of the base member.

In still another embodiment, the cap lifting apparatus also includes a locking pin bracket affixed to the vertical support. A spring-loaded locking pin is operatively positioned about the locking pin bracket. The elongated projected portion of the base member includes a first recess and a second recess, each of which is dimensioned to receive the spring-loaded locking pin when actuated. The spring-loaded locking pin engages the first recess when the vertical support member is rotated to a cap engagement position. In the cap engagement position, the cap is capable of being raised or lowered about the cap sub. The spring-loaded locking pin engages the second recess when the vertical support member is rotated to a non-cap engagement position.

In an embodiment, a method of raising or lowering a cap includes the steps of providing a cap lifting apparatus and actuating the hydraulic piston. The step of providing a cap lifting apparatus includes providing a frame assembly and a hydraulic cylinder. The frame assembly includes a base member, a vertical support member, and a horizontal support member. The vertical support member has an upper end and a lower end. The horizontal support member has a distal end and a proximal end. The base member includes an enlarged ring portion, which is configured to receive a cap sub that is operatively attached to a wellhead, and an elongated projected portion, which includes a bore, which rotatably receives the lower end of the vertical support member. The proximal end of the horizontal support member is operatively connected to the upper end of the vertical support member. The hydraulic cylinder has an upper end, a lower end, a piston head, and a piston rod. The piston head is contained within the hydraulic cylinder. The piston rod is connected to the piston head and extends from the lower end of the hydraulic cylinder for operative attachment to a cap. Actuation of the hydraulic piston causes the cap to be raised or lowered about the cap sub.

In another embodiment, the method of raising or lowering a cap includes the steps of actuating the hydraulic piston to raise the cap from the cap sub and rotating the vertical support member at least 90 degrees in a clockwise or counterclockwise direction.

In still another embodiment, the method of raising or lowering a cap includes the steps of rotating the vertical support member so that the hydraulic piston is in substantial axial alignment with the cap, actuating the hydraulic piston to lower the cap onto the cap sub, and operatively affixing the cap to the cap sub.

DETAILED DESCRIPTION OF THE INVENTION

Figure 1:
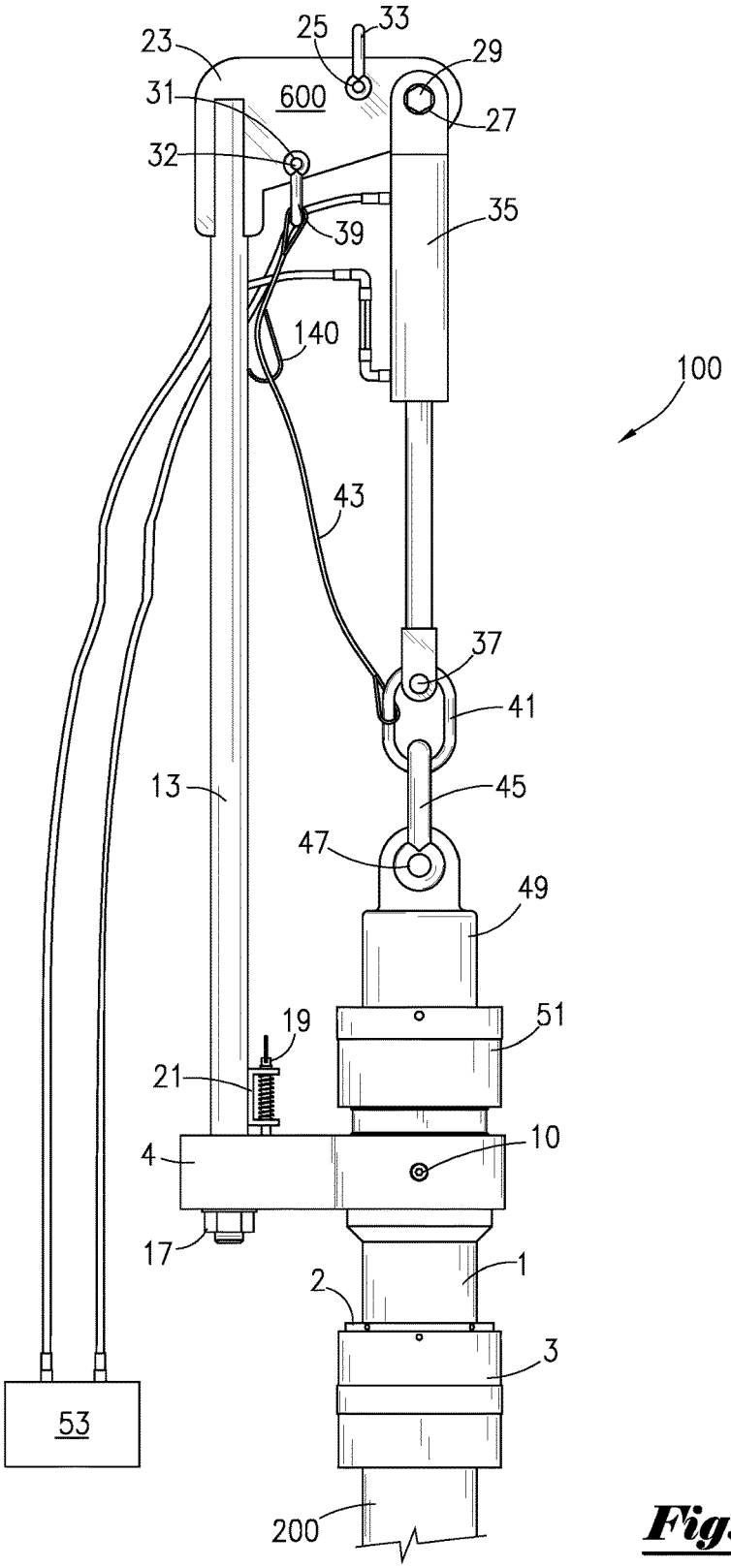
FIG. 1 is a side view of a lifting apparatus in a lowered position.

With reference to FIG. 1, cap lifting apparatus 100 may include frame assembly 600. Frame assembly 600 may include base member 4, vertical support member 13, and horizontal support member 23. Cap lifting apparatus 100 may also include hydraulic pump 53, cap sub 1, and cap 49. Cap lifting apparatus 100 may be composed of a metal, metals, or metal alloy(s) suitable for the intended purpose. In an embodiment, cap lifting apparatus 100 may be composed of steel.

Figure 2:
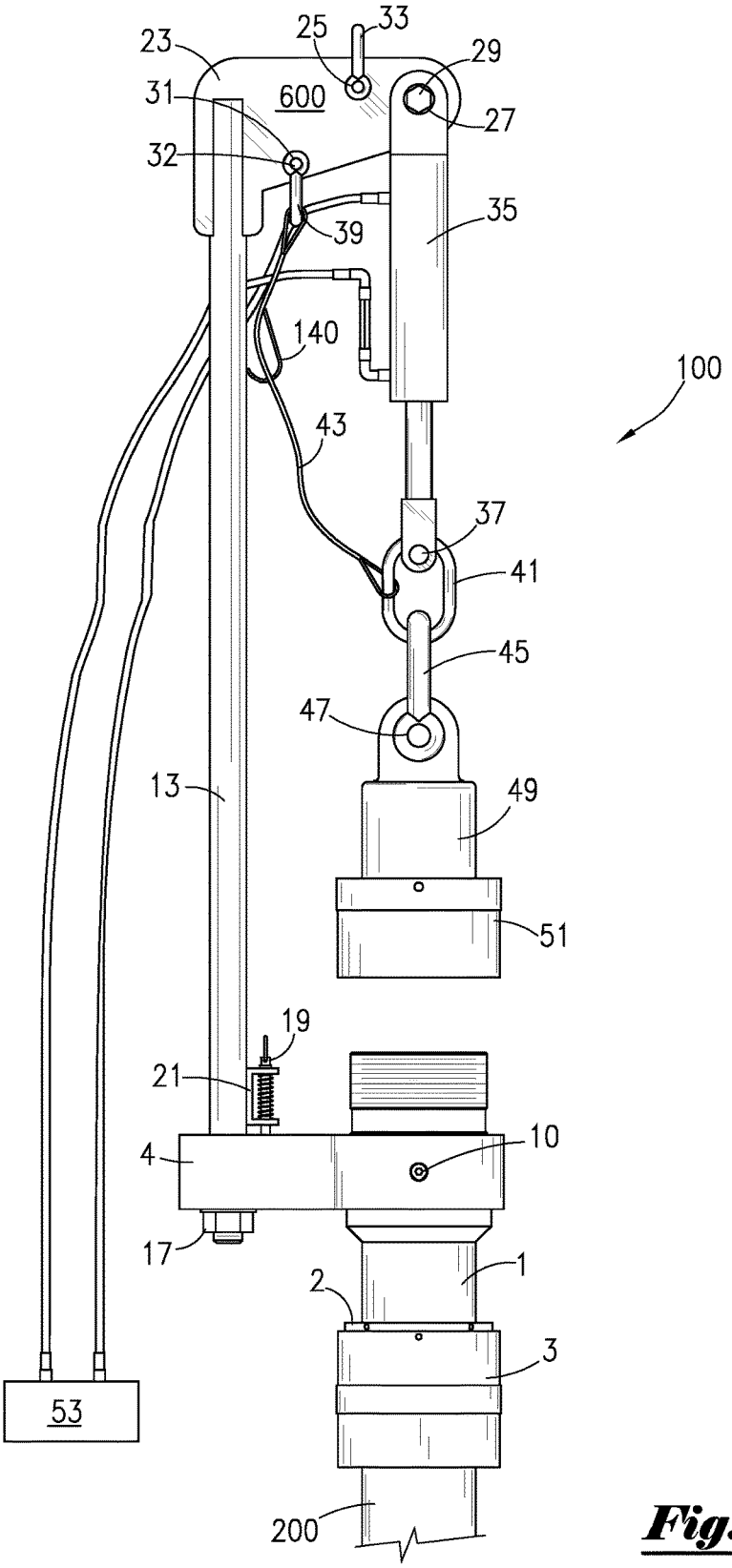
FIG. 2 is a side view of the lifting apparatus in a raised position.
Figure 3:
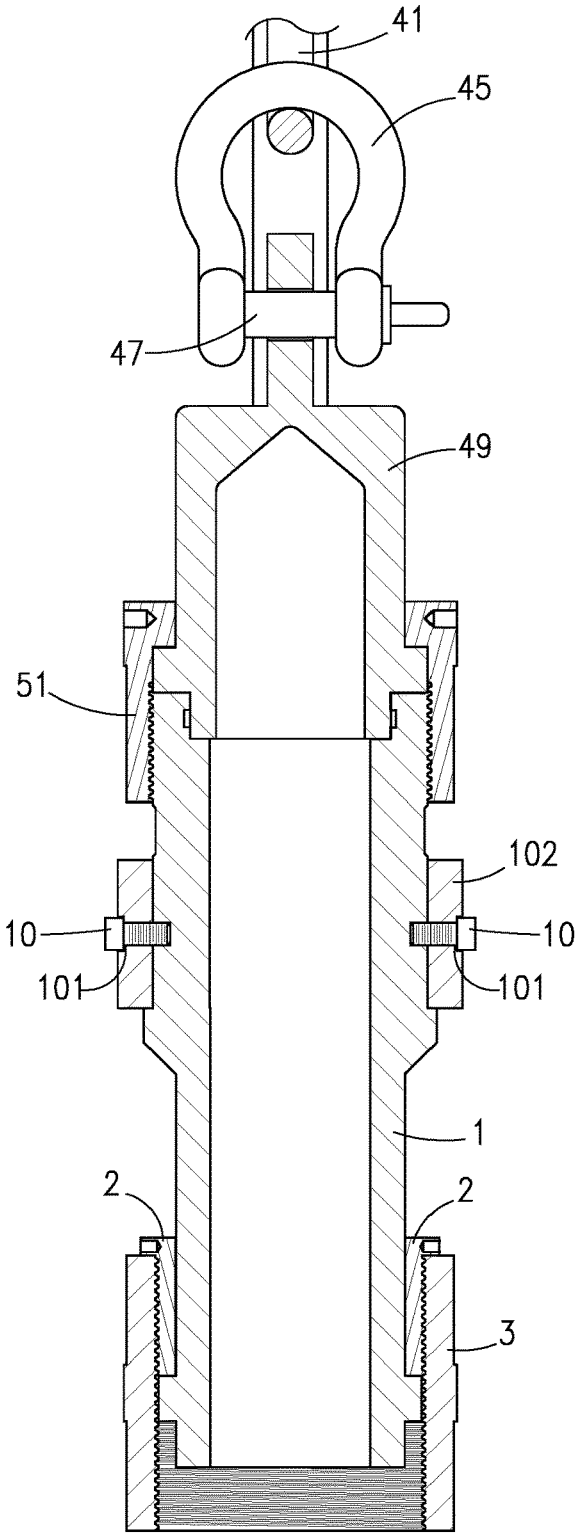
FIG. 3 is a partial cross-sectional front view of part of the wellhead assembly and lifting apparatus.
Figure 4:
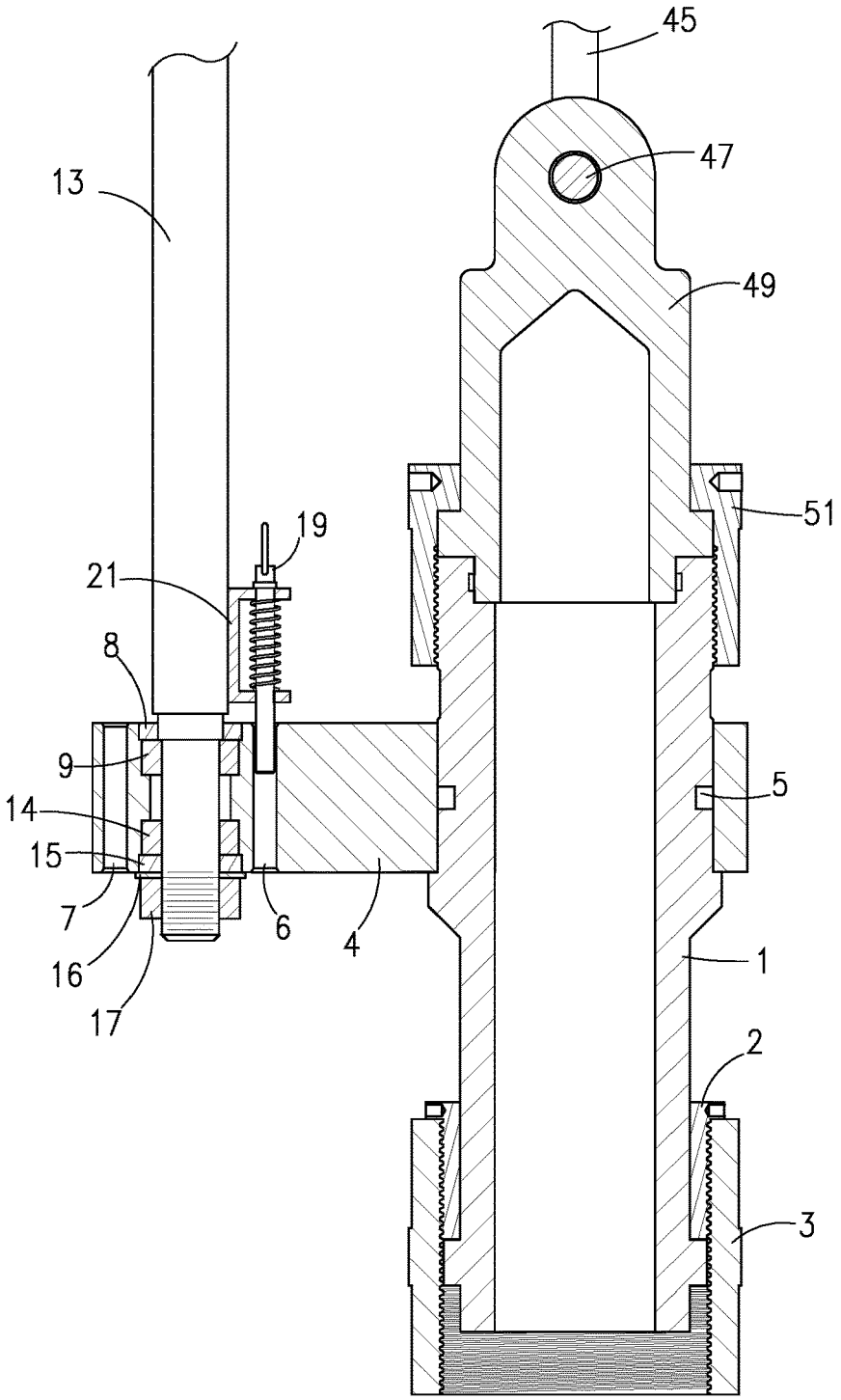
FIG. 4 is a partial cross-sectional side view of part of the wellhead assembly and lifting apparatus.

Cap lifting apparatus 100 includes cap sub 1 that is to be installed or is already installed onto pre-existing wellhead 200. The cap sub 1 may be a night cap sub or a lifting sub. Wellhead 200 may be a wellhead or a stack that is installed on a wellhead. In one embodiment, the wellhead 200 is a wellhead. In another embodiment, the wellhead 200 is a stack located at the top of the wellhead. Cap 49 may be night caps, lifting caps, or a load device. In one embodiment, cap 49 is a night cap. In another embodiment, cap 49 is a lifting cap. As shown in FIGS. 2-4, cap sub 1 may be installed onto pre-existing wellhead 200 through the wellhead assembly, which comprises cap sub 1, thread thru nut 3 and split ring 2. Split ring may be disposed within the thread thru nut 3 around the cap sub 1. The outer surface of cap sub 1 includes circumferential groove 5 (shown in FIGS. 3 and 4).

Cap sub 1 may be of various dimensions depending on the size of the wellhead and the union. Cap sub 1 is comprised of a metal, metals, or metal alloy(s) suitable for the intended purpose. In one embodiment, cap sub 1 is comprised of steel. Cap sub 1 may include circumferential groove 5, as shown in FIGS. 3 and 4. Circumferential groove 5 is sized so that it is capable of receiving locking screw 10. Locking screw 10 may be any size or composition suitable for the intended purpose, retaining the lifting apparatus on cap sub 1. In one embodiment, locking screws 10 may be ½-inch threaded locking screws. In another embodiment, locking screws 10 may be ¾-inch threaded locking screws. Cap sub 1 is removably connected to the wellhead 200 through a thread thru nut 3. The thread thru nut 3 may have an upper section, a lower section, and internal threads. In operation, the lower section of the thread thru nut 3 is threadably connected to the wellhead 200 and the lower section of the cap sub 1 is placed into the upper section of the thread thru nut 3 to engage the wellhead 200.

Figure 5:
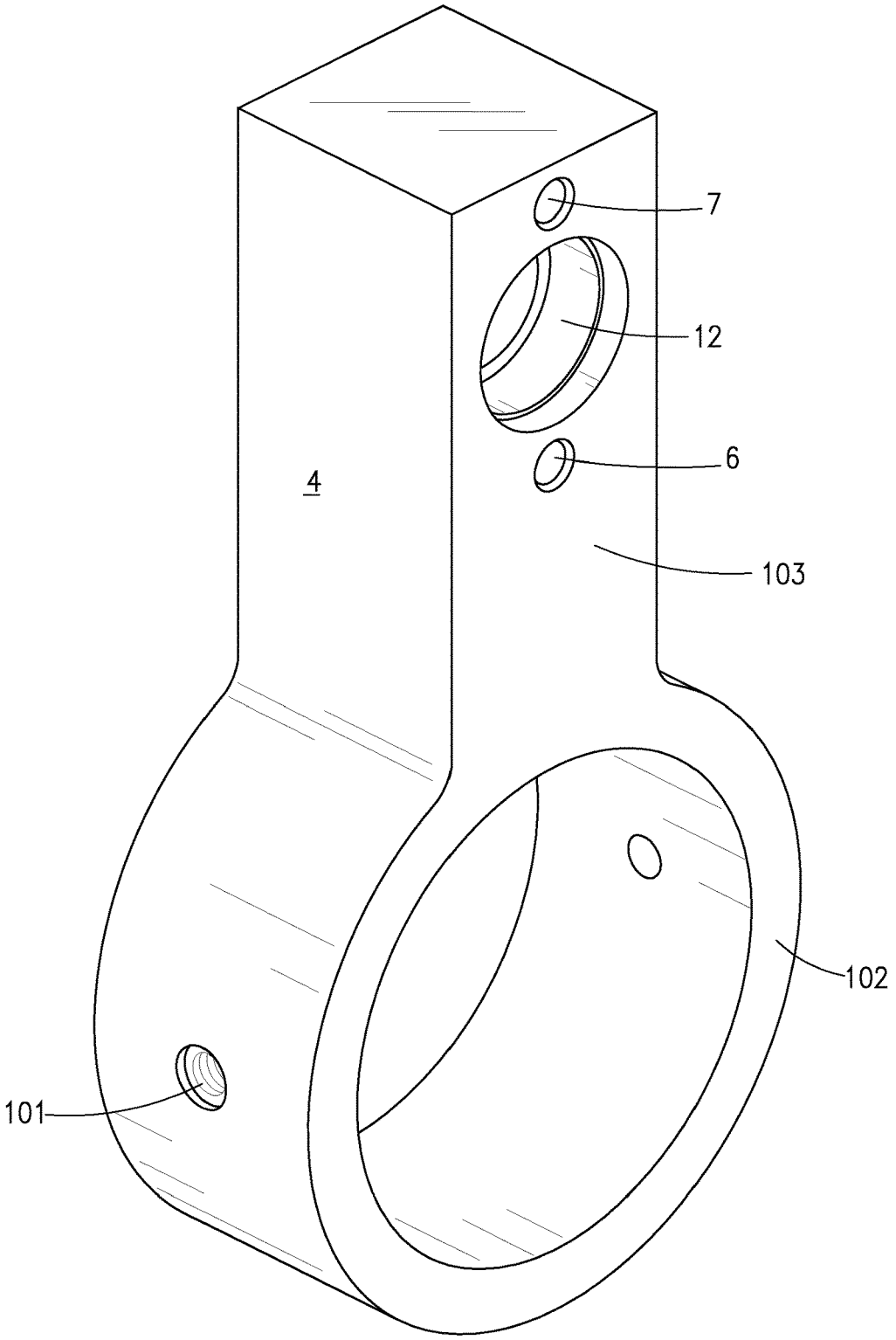
FIG. 5 is a perspective view of the base member of the lifting apparatus.
Figure 6:
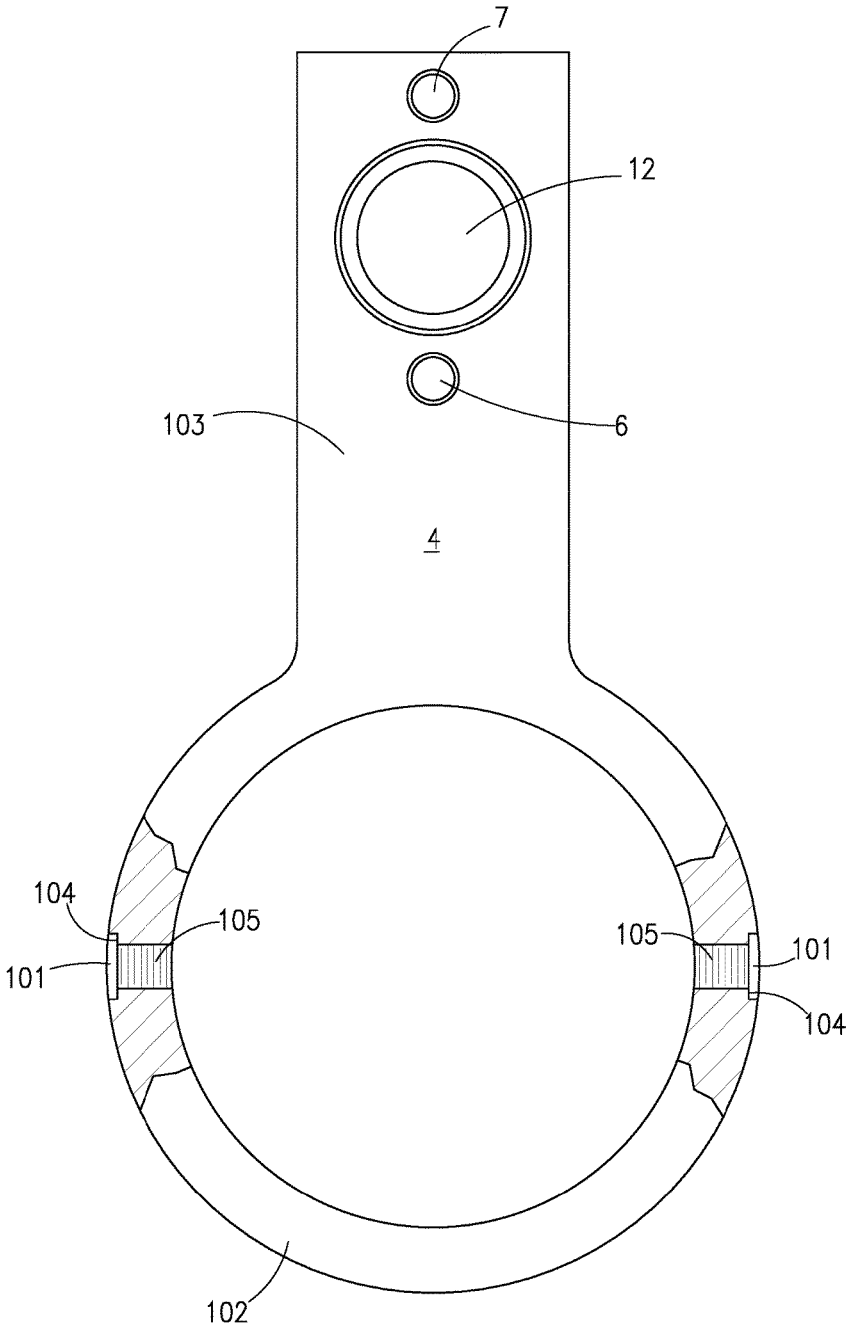
FIG. 6 is a top view of the base member.
Figure 7:
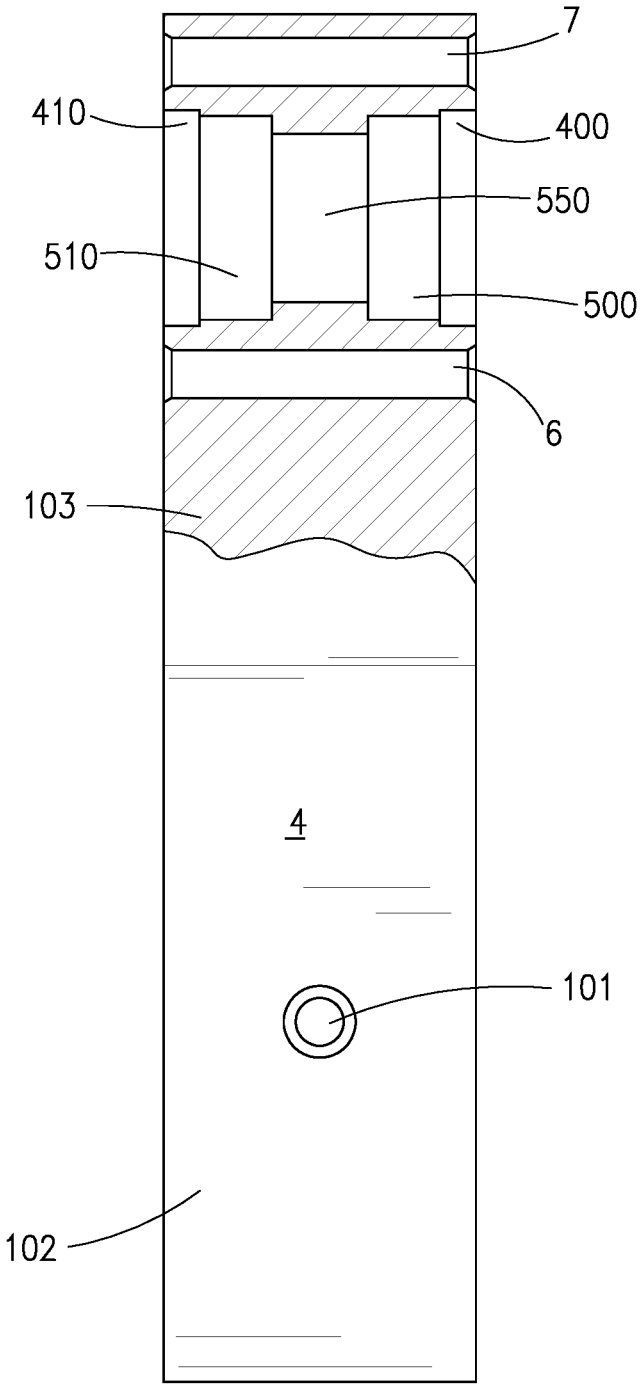
FIG. 7 is a side view of the base member with partial cross-sectional view of the bore and first and second recesses in the elongated projected portion.

Lifting apparatus 100 may also include base member 4, which may serve as a foundation member and a base for resultant lifting forces resulting from the load being lifted. The weight of the lifting apparatus is supported by cap sub 1, through the attachment of the lifting apparatus 100 to cap sub 1 via the base member 4. Base member 4 is connected to cap sub 1 (shown in FIGS. 2-7). As shown in FIG. 6, base member 4 may include enlarged ring portion 102 that has an approximately circular opening that extends from the top side of base member 4 to the bottom side of base member 4. As shown in FIGS. 5 and 6, base member 4 includes elongated projected portion 103, located at the opposite end of base member 4 from enlarged ring portion 102. The elongated projected portion 103 extends away from enlarged ring portion 102. As shown in FIG. 3 and FIGS. 5-7, base member 4 may include apertures 101 through the side of enlarged ring portion 102. Apertures 101 may be approximately cylindrical in shape and may be positioned in approximately opposing locations of enlarged ring portion 102. Apertures 101 may be located such that a line drawn between them is substantially perpendicular to elongated projected portion 103. Apertures 101 are sized so that they are capable of receiving locking screws 10. As shown in FIGS. 6 and 7, apertures 101 may have a screw head receiving portion 104 and a screw thread receiving portion 105. Screw head receiving portion 104 is sized so that at least part of the head of a locking screw 10 will fit within screw head receiving portion 104. In one embodiment, screw head receiving portion 104 is substantially circular when viewed from the side of enlarged ring portion 102 and is capable of receiving the head of a ½-inch threaded locking screw. In another embodiment, screw head receiving portion 104 is substantially circular when viewed from the side of enlarged ring portion 102 and is capable of receiving the head of a ¾-inch threaded locking screw. Screw thread receiving portion 105 is smaller in diameter than screw head receiving portion 104. Screw thread receiving portion 105 is sized so that the threads of a locking screw 10 will fit within the screw thread receiving portion 105, but the head of locking screw 10 will not fit through screw thread receiving portion 105 and will instead be retained in screw head receiving portion 104. In one embodiment, the screw thread receiving portion 105 is substantially cylindrical and is capable of receiving the threaded portion of a ½-inch threaded locking screw. In another embodiment, the screw thread receiving portion 105 is substantially cylindrical and is capable of receiving the threaded portion of a ¾-inch threaded locking screw. In one embodiment, enlarged ring portion 102 has two apertures 101, a first aperture and a second aperture. In another embodiment, enlarged ring portion 102 has two apertures 101, a first aperture and a second aperture, and each aperture has a screw head receiving portion 104 and a screw thread receiving portion 105. In use, the enlarged ring portion 102 of base member 4 is placed over cap sub 1, locking screws 10 (shown in FIG. 3) are threaded through apertures 101 of base member 4 and into circumferential groove 5 of cap sub 1. In this way, base member 4 may be removably attached to cap sub 1. Base member 4 may be of any size as long as it can support the weight of the lifting apparatus 100 with the added cap 49, without deforming. The cap 49 may be a night cap or a lifting cap, a load device, or any similar tool or sub that is to be placed onto the wellhead 200. In one embodiment, the cap 49 is night cap. In another embodiment, the cap 49 is a lifting cap. In another embodiment, the cap 49 is a load device.

As shown in FIGS. 5-7, base member 4 may also include bore 12, as shown in FIGS. 5-7. Bore 12 may be machined. Bore 12, may include an inner bore wall 550 with a profile. The profile of inner bore wall 550 may include an upper seal shoulder 400, an upper bearing shoulder 500, a lower bearing shoulder 510, and a lower seal shoulder 410. The inner bore wall 550 is dimensioned so that the second reduced diameter portion 220 of vertical support member 13 is capable of being placed through inner bore wall 550. The diameter of inner bore wall 550 is less than the diameter of upper seal shoulder 400, upper bearing shoulder 500, lower bearing shoulder 510 and lower seal shoulder 410. Upper seal shoulder 400 has a diameter sufficient to retain upper seal means 8 in a sealing engagement when the lower end of vertical support member 13 is placed into bore 12. Upper bearing shoulder 500 has a diameter sufficient to receive upper bearing means 9. Lower seal shoulder 410 has a diameter sufficient to retain lower seal means 15 in a sealing engagement when the lower end of vertical support member 13 is placed into bore 12. Lower bearing shoulder 510 has a diameter sufficient to receive lower bearing means 14.

Upper seal means 8 and lower seal means 9 may be any device that is capable of retaining the base member 4 in a sealing engagement with the lower end of vertical support member 13 to prevent leakage. Sealing means are well known in the art and include, but are not limited to, o-rings and gaskets. Additionally, seal means can be made of any material that prevents leakage.

Upper bearing means 9 and lower bearing means 14 may be any device that is capable of operating as a typical bearing. Bearing means are well known in the art and include, but are not limited to, plain bearings, bushings, fluid bearings, and rolling-element bearings.

Figure 8:
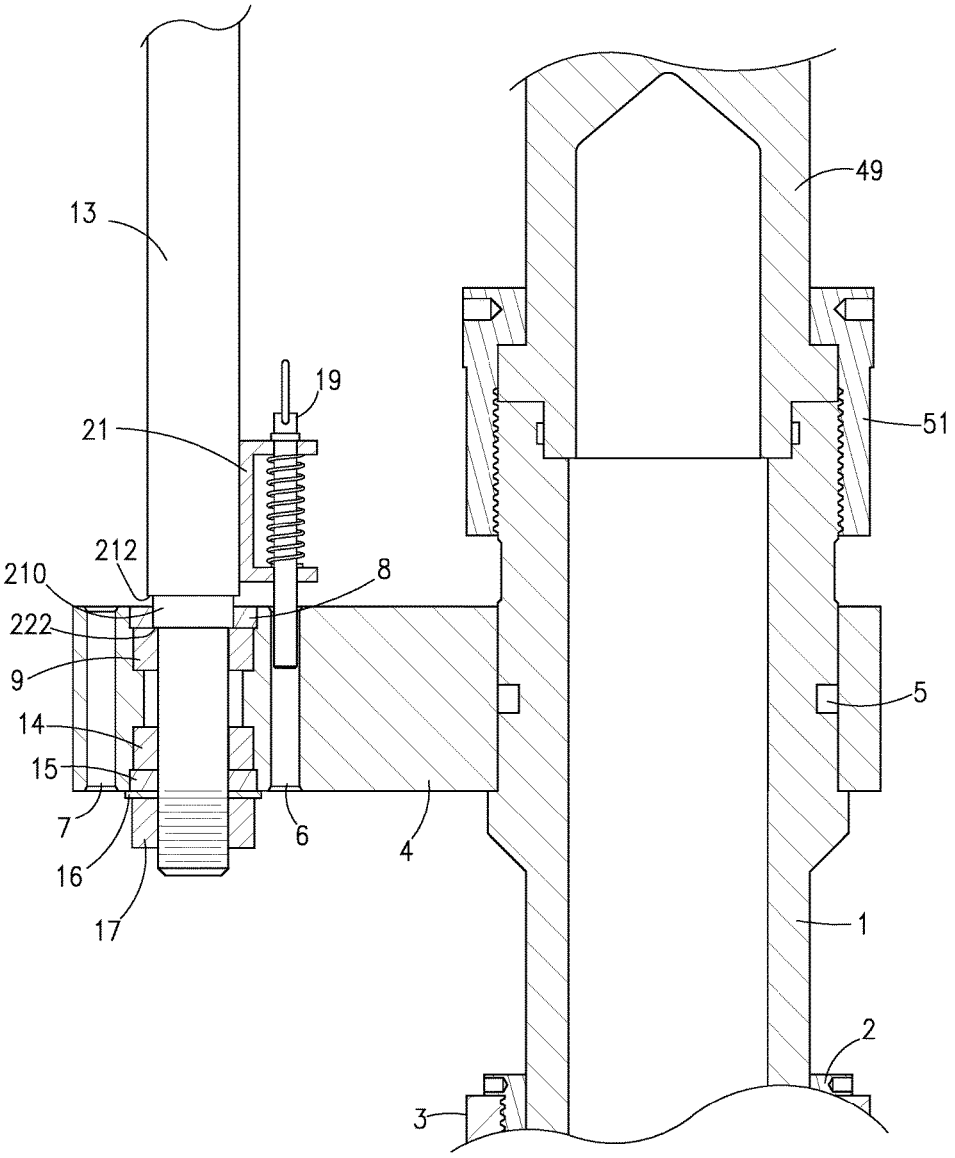
FIG. 8 is a partial cross-sectional view of part of the wellhead assembly and lifting apparatus showing the connection of the vertical support member to the base member.

Vertical support member 13 may comprise an upper end of vertical support member 13 and a lower end of vertical support member 13. A lower end of vertical support member 13 (shown in FIGS. 1, 2, and 4) connects to base member 4. As shown in FIGS. 5-7, elongated projected portion 103 of base member 4 has bore 12, which is described above. As shown in FIG. 8, lower end of vertical support member may have a first reduced diameter portion 210 and a second reduced diameter portion 220. The diameter of first reduced diameter portion 210 is less than the diameter of the upper end of vertical support member 13 and a first shoulder 212 is formed by the reduction in diameter. The diameter of second reduced diameter portion 220 is less than the diameter of first reduced diameter portion 210 and second shoulder 222 is formed by the reduction in diameter. In operation, when lower end of vertical support member 13 is placed into bore 12, through upper seal means 8, upper bearing means 9, lower bearing means 14, and lower seal means 15, the second shoulder 222 rests on top of upper bearing means 9, which assists in retaining vertical support member 13 in base member 4. After the lower end of vertical support member 13 is inserted through bore 12, vertical support member 13 extends below the elongated projected portion 103 and is secured to base member 4 using retainer washer 16 and hex nut 17. In one embodiment, hex nut 17 is a locking hex nut. The lower end of vertical frame support 13 may include an exterior threaded portion. Hex nut 17 may include an interior threaded portion. After the lower end of vertical support member 13 is positioned in bore 12 and the external threaded portion of lower end of vertical support member 13 extends below the elongated projected portion 103. Retainer washer 16 is then placed around the external threaded portion of lower end of vertical support member 13 and hex nut is threadably connected to the lower end of vertical support member 13 through the external threaded portion of lower end of vertical support member 13 and the internal threaded portion of hex nut 17.

Elongated projected portion 103 of base member 4 may further comprise first recess 6 and second recess 7, as shown in FIGS. 4, 6, and 8. First recess 6 and second recess 7 each have a diameter sufficient to receive the bottom portion of a spring-loaded locking pin 19 (shown in FIGS. 2 and 4). The lower end of vertical support member 13 may further comprise a locking pin bracket 21 (shown in FIG. 2). Locking pin bracket 21 is located above the first reduced diameter portion of the lower end of vertical support member 13. Locking pin bracket 21 has a first arm and a second arm, which are connected by a substantially planar bracket base. First arm and second arm of locking pin bracket 21 are located at opposing ends of the bracket base and are substantially parallel to each other. First arm and second arm of locking pin bracket 21 each comprise an aperture for receiving spring-loaded locking pin 19. Spring-loaded locking pin 19 is placed through locking pin bracket 21 and into either first recess 6 or second recess 7, to lock the vertical support member 13 into place in base member 4 and prevent vertical support member 13 from further rotating in bore 12 of base member 4.

Vertical support member 13 is of sufficient length for full extension of hydraulic cylinder 35 and attached caps, such as oilfield lifting caps, night caps, or other load devices. Vertical support member 13 may have different lengths based on the size of the night cap, lifting cap, load device or union. Vertical support member 13 should be of sufficient length such that when the hydraulic cylinder 35 is in an extended (lowered) position, the cap 49 will completely engage cap sub 1.

Vertical support member 13 may be turned to rotate hydraulic cylinder 35 in order to selectively place hydraulic cylinder 35 (with or without an attached cap, such as an lifting cap, night cap, or other load device) over the cap sub 1 or rotated to move hydraulic cylinder 35 to another position away from the top of cap sub 1. Spring-loaded locking pin 19 may be locked in first recess 6 when hydraulic cylinder 35 (FIG. 2) is positioned in a cap engagement position over the cap sub 1. The cap engagement position is the position the lifting apparatus should be in when raising or lowering the cap about the cap sub. Spring-loaded locking pin 19 may be locked into second recess 7 when vertical frame member 13 is in a non-cap engagement position and turned away from cap sub 1. In one embodiment, spring-loaded locking pin 19 is locked into second recess 7 in order to position hydraulic cylinder 35 in a non-cap engagement position that is approximately 180 degrees away from cap sub 1.

Hook 140 is attached to vertical support member 13 for use as a mechanism to secure the hydraulic hoses.

Horizontal support member 23 (FIG. 2) is attached to the upper end of vertical frame member 13. Horizontal frame member 23 may have a distal end and a proximal end. The proximal end of horizontal frame member 23 may be operatively connected to the upper end of the vertical support member 13. In one embodiment, the proximal end of horizontal frame member 23 is connected to the upper end of vertical support member 13 via welding. Vertical support member 13 and horizontal support member 23 may be capable of sustaining loads up to the load capacity of hydraulic cylinder 35. The hydraulic cylinder 35 to be attached to horizontal support member 23 should be capable of lifting the selected cap.

Hydraulic cylinder 35 may have an upper end and a lower end. The hydraulic cylinder 35 may include a hydraulic piston. The hydraulic piston may include a piston head contained within the hydraulic cylinder and a piston rod connected to the piston head and extending from the lower end of the hydraulic cylinder 35. The piston rod may be operatively attached to a cap 49 so that actuation of the hydraulic piston causes the cap to raise or lower about cap sub 1.

Horizontal support member 23 may comprise through-hole 25 (as shown in FIG. 2). Lifting shackle 33 is connected to the horizontal support member through-hole 25 through use of a bolt. Through-hole 25 should be dimensioned so that it is capable of receiving the bolt of the lifting shackle 33. Lifting shackle 33 and its bolt should be dimensioned and comprised of materials sufficient to support the weight of the lifting apparatus with the attached cap. In operation, lifting apparatus 100 is attached to a machine or device that is capable of lifting the lifting apparatus 100 over wellhead 200 by lifting shackle 33 and its bolt. Non-limiting examples of machines or devices that may be used to lift the lifting apparatus 100 over wellhead 200 include outfitted man lifts and cranes of suitable lift capacity. In operation, the machine or device lifts lifting apparatus 100 over and onto wellhead 200 (FIGS. 1 and 2) for attachment to wellhead 200 through cap sub 1.

Hydraulic cylinder 35 is attached to horizontal support member 23. By way of example, bolt 29 may engage hole 27 in hydraulic cylinder 35 and a corresponding hole in horizontal support member 23 (FIGS. 1 and 2). Both hole 27 and the corresponding hole in horizontal support member 23 are dimensioned such that they are capable of receiving bolt 29. Bolt 29 should be selected so that it is sufficient to support the weight of hydraulic cylinder 35 as well as the weight of the cap. Hydraulic cylinder 35 is suspended with hydraulic piston pointing downward to be attached to cap 49. The bottom of hydraulic cylinder 35 is attached to cap 49. By way of example, bolt 37 may suspend ring 41 from the bottom of hydraulic cylinder 35. Ring 41 interconnects the piston rod to second shackle 45. Second shackle 45 is placed through ring 41. Cap 49 (FIGS. 1 and 2) may be attached to second shackle 45 through bolt 47 (FIGS. 1 and 2). Bolts 37 and 47 should be selected so that they are sufficient to support the weight of cap 49. Ring 41 should be dimensioned so that it is capable of receiving both bolt 37 and second shackle 45. Ring 41 should also be dimensioned and selected so that it is sufficient to support the weight of cap 49. Second shackle 45 should be dimensioned such that it can engage cap 49 and should be selected so that it is sufficient to support the weight of cap 49.

Lifting apparatus may comprise safety line 43 as a safety feature. One end of safety line 43 is connected to ring 41. The other end of safety line 43 is connected to first shackle 39, which is attached to horizontal support member 23 by positioning bolt 32 through through-hole 31 in horizontal support member 23. Through-hole 31 is dimensioned so that it is capable of receiving bolt 32. First shackle 39, bolt 32, and safety line 43 should be selected so that they can support the weight of cap 49. Safety line 43 is connected to ring 41 and first shackle 39 in a manner that prevents safety line 43 from detaching from each structure. In some embodiment, safety line 43 is connected to ring 41 and first shackle 39 by fasteners. Non-limiting examples of fasteners include rings (similar to ring 41), or shackles. Safety line 43 may act as a safety mechanism to prevent an item or load being lifted from accidentally falling away from lifting apparatus 100 and wellhead 200. Safety line 43 may be any material capable of supporting the weight of cap 49. Non-limiting examples of materials for safety line include wire rope, cables, steel cable, and rope. In one embodiment, the safety line 43 is ¼-inches in diameter and is capable of supporting at least approximately 1200 pounds. In another embodiment, safety line 43 is capable of supporting between approximately 1200 pounds and approximately 1400 pounds. In an alternate embodiment, multiple safety lines 43 are connected to ring 41 and first shackle 39.

Lifting apparatus 100 may remain attached to cap 49 and nut 51 (FIGS. 1 and 2) for capping wellhead 200 when wellhead 200 is not being used for downhole operations. Nut 51 is the means by which cap 49 is connected to cap sub 1. Nut 51 can be any nut type device that is known in the art and is capable of removably securing cap 49 to cap sub 1. Nut 51 may be of various dimensions depending on the size of the wellhead 200, the cap 49, and the union. Lifting apparatus 100 may hold and suspend cap 49 and nut 51 or other loads being lifted when the load being lifted and suspended. Additionally, as a safety feature, lifting apparatus 100 may hold and suspend cap 49 and nut 51, or other loads being lifted, when the load or other items are rotated 180 degrees away from the wellhead 200 (and locked into place to prevent the load from injuring a person or equipment over the wellhead) to allow for the wellhead 200 to be accessed for downhole operations.

Second shackle 45 with bolt 47 may be used to attach and lift any loads with hydraulic cylinder 35 above a wellhead 200. For example, lifting apparatus 100 may be attached to oilfield lifting caps, night caps, other load devices, or also to secure other items to/from a personnel basket when such items are appropriate to move the cap or other items into position to be attached to the lifting apparatus 100, as readily apparent by a skilled artisan.

A commercially available hydraulic pump 53 (FIGS. 1 and 2) may be used to provide hydraulic fluid pressure to raise or lower hydraulic cylinder 35, or to suspend a cap attached to hydraulic cylinder 35.

The lifting apparatus 100 may be used to raise or lower a cap 49. The cap 49 may be lowered onto a wellhead assembly or raised up and away from a wellhead assembly. The steps for raising or lowering a cap 49 include providing a cap 49 and actuating a hydraulic piston to lower the cap 49 onto the cap sub 1. The lifting apparatus 100 and hydraulic cylinder 35 may include some or all of the features, as described above. To install the lifting apparatus 100 onto a wellhead assembly, which includes wellhead 200, the cap sub 1 is detachably connected to the wellhead 200. Lifting apparatus 100 is detachable connected to cap sub 1 through enlarged ring portion 102 of base member 4. Vertical support member 13 is rotatably retained within bore 12 of elongated projected portion 103 of base member 4. The proximal end of horizontal support member 23 is attached to the upper end of vertical support member 13. Hydraulic cylinder 35 is attached to the distal end of horizontal support member 23. The hydraulic cylinder 35 includes a hydraulic piston. The hydraulic piston may include a piston head, which is contained within the hydraulic cylinder, and a piston rod, which is connected to the piston head and extends from the lower end of the hydraulic cylinder 35. A cap 49 may be operatively connected to the hydraulic piston. A hydraulic pump 53 is used to actuate the hydraulic cylinder 35, which results in the hydraulic piston being raised or lowered. The vertical support member is rotated about base member 4, to position cap 49 over the wellhead assembly. Then, the hydraulic pump 53 is used to actuate hydraulic cylinder 35 and lower cap 49 onto cap sub 1, which is connected to the wellhead assembly. The cap 49 is then connected to the cap sub 1. When access to the wellhead assembly is needed, cap 49 is detached from cap sub 1. The hydraulic pump 53 is used to actuate hydraulic cylinder 35 to raise cap 49 above cap sub 1. The vertical support member 13 is then rotated about base member 4, so that cap 49 is no longer positioned above the wellhead assembly.

Vertical support member 13 may also include a locking pin bracket 21. Further, the elongated projected portion 103 of base member 4 may include a first recess 6 and second recess 7, each recess dimensioned to receive a spring-loaded locking pin 19. In use, when the vertical support member 13 is rotated about base member 4, so that the lifting apparatus 100 is in a cap-engagement position, with the cap being positioned above cap sub 1, spring-loaded locking pin 19 is actuated so that it is received into the first recess 6. When the spring-loaded locking pin 19 is in the first recess 6, the vertical support member 13 is not capable of being rotated about base member 4 and is locked into the cap-engagement position. To unlock the device, spring-loaded locking pin 19 is removed from first recess 6, allowing the vertical support member 13 to again be rotated about base member 4. When the vertical support member 13 is rotated about base member 4, so that the lifting apparatus 100 is in a non-cap engagement position, with the cap being positioned so that it is no longer above cap sub 1, spring-loaded locking pin 19 is actuated so that it is received into the second recess 7. When the spring-loaded locking pin 19 is in the second recess 7, the vertical support member 13 is not capable of being rotated about base member 4 and is locked into the non-cap engagement position. To unlock the device, spring-loaded locking pin 19 is removed from second recess 7, allowing the vertical support member 13 to again be rotated about base member 4. In one embodiment, the non-cap engagement position is approximately an 180 degree rotation about base member 4 from the cap-engagement position.

While preferred embodiments of the present invention have been described, it is to be understood that the embodiments described are illustrative only and that the scope of the invention is to be defined solely by the appended claims when accorded a full range of equivalents, many variations and modifications naturally occurring to those skilled in the art from a perusal hereof.

What is claimed is:

1. A cap lifting apparatus comprising:

a frame assembly including a base member, a vertical support member having an upper end and a lower end, and a horizontal support member having a distal end and a proximal end, the base member including an enlarged ring portion configured to receive a cap sub operatively attached to a wellhead and an elongated projected portion including a bore rotatably receiving the lower end of the vertical support member, the proximal end of the horizontal support member operatively connected to the upper end of the vertical support member;

a hydraulic cylinder having an upper end and a lower end, the hydraulic cylinder including a hydraulic piston having a piston head contained within the hydraulic cylinder and a piston rod connected to the piston head and extending from the lower end of the hydraulic cylinder for operative attachment to a cap so that actuation of the hydraulic piston causes the cap to raise or lower about the cap sub;

wherein the enlarged ring portion of the base member includes a first aperture configured to receive a first locking screw for operative attachment of the base member to the cap sub.

2. The cap lifting apparatus of claim 1, wherein the enlarged ring portion of the base member includes a second aperture configured to receive a second locking screw for operative attachment of the base member to the cap sub.

3. The cap lifting apparatus of claim 1, wherein the bore of the elongated projected portion of the base member is defined by an inner bore wall with a profile.

4. The cap lifting apparatus of claim 3, wherein the profile of the inner bore wall contains an upper bearing shoulder and a lower bearing shoulder, and wherein an upper bearing means is accommodated on the upper bearing shoulder and a lower bearing means is accommodated on the lower bearing shoulder.

5. The cap lifting apparatus of claim 4, wherein the profile of the inner bore wall contains an upper seal shoulder and a lower seal shoulder, and wherein an upper seal means is accommodated on the upper seal shoulder and a lower seal means is accommodated on the lower seal shoulder.

6. The cap lifting apparatus of claim 5, wherein the lower end of the vertical support member extends through the inner bore wall and below the elongated projected portion of the base member, and wherein the vertical support member is rotatably affixed to the base member by a retainer washer positioned between the vertical support member and the lower seal means and by a hex nut affixed to the lower end of the vertical support member that extends below the elongated projection of the base member.

7. The cap lifting apparatus of claim 1, further comprising a locking pin bracket affixed to the vertical support member, a spring-loaded locking pin operatively positioned about the locking pin bracket, and wherein the elongated projected portion of the base member includes a first recess and a second recess each dimensioned to receive the spring-loaded locking pin when actuated.

8. The cap lifting apparatus of claim 7, wherein the spring-loaded locking pin engages the first recess when the vertical support member is rotated to a cap engagement position to raise or lower the cap about the cap sub and wherein the spring-loaded locking pin engages the second recess when the vertical support member is rotated to a non-cap engagement position.

9. The cap lifting apparatus of claim 8, wherein in the non-cap engagement position, the vertical support member is rotated about 180 degrees from the cap-engagement position.

10. The lifting apparatus of claim 1, further comprising a through-hole in the horizontal support member to which is affixed a first shackle, a second shackle operatively affixed to the cap, a ring interconnecting the piston rod and the second shackle, and a safety line having a first end connected to the first shackle and a second end connected to the ring.

11. The cap lifting apparatus of claim 1, wherein the cap is a lifting cap, a night cap, or a load device.

12. A cap lifting apparatus comprising:

a well head assembly including a cap sub having an upper section and a lower section, a thread thru nut having an upper section, a lower section, and internal threads, a split ring, and a wellhead, the wellhead being threadably attached to the lower section of the thread thru nut, the lower section of the cap sub member being positioned in the upper section of the thread thru nut, and the split ring threadedly connected to the upper section of the thread thru nut and positioned between the thread thru nut and the cap sub;

a frame assembly including a base member, a vertical support member having an upper end and a lower end, and a horizontal support member having a distal end and a proximal end, the base member including an enlarged ring portion operatively receiving the cap sub and an elongated projected portion including a machined bore rotatably receiving the lower end of the vertical support member, the proximal end of the horizontal support member operatively connected to the upper end of the vertical support member;

a hydraulic cylinder having an upper end and a lower end, the hydraulic cylinder including a hydraulic piston having a piston head contained within the hydraulic cylinder and a piston rod connected to the piston head and extending from the lower end of the hydraulic cylinder;

a cap operatively attached to the piston head so that actuation of the hydraulic piston causes the cap to raise or lower about the cap sub;

a through-hole in the horizontal support member;

a first shackle operatively affixed to the through-hole in the horizontal support member;

a second shackle operatively affixed to the cap;

a ring interconnecting the piston rod and the second shackle;

a safety line having a first end connected to the first shackle and a second end connected to the ring.

13. The cap lifting apparatus of claim 12, wherein the enlarged ring portion of the base member includes a first aperture receiving a first locking screw for operative attachment of the base member to the cap sub and a second aperture receiving a second locking screw for operative attachment of the base member to the cap sub, and wherein an outer surface of the cap sub includes a circumferential groove to receive the first and second locking screws.

14. The cap lifting apparatus of claim 13, wherein the bore of the elongated projected portion of the base member is defined by an inner bore wall with a profile, the profile of the inner bore wall contains an upper bearing shoulder and a lower bearing shoulder, an upper bearing means is accommodated on the upper bearing shoulder and a lower bearing means is accommodated on the lower bearing shoulder, and wherein the profile of the inner bore wall contains an upper seal shoulder and a lower seal shoulder, and wherein an upper seal means is accommodated on the upper seal shoulder and a lower seal means is accommodated on the lower seal shoulder.

15. The cap lifting apparatus of claim 14, wherein the lower end of the vertical support member extends through the inner bore wall and below the elongated projected portion of the base member, and wherein vertical support member is rotatably affixed to the base member by a retainer washer positioned between the vertical support member and the lower seal means and by a hex nut affixed to the lower end of the vertical support member that extends below the elongated projection of the base member.

16. The cap lifting apparatus of claim 12, further comprising a locking pin bracket affixed to the vertical support, a spring-loaded locking pin operatively positioned about the locking pin bracket, wherein the elongated projected portion of the base member includes a first recess and a second recess each dimensioned to receive the spring-loaded locking pin when actuated, wherein the spring-loaded locking pin engages the first recess when the vertical support member is rotated to a cap engagement position to raise or lower the cap about the cap sub and wherein the spring-loaded locking pin engages the second recess when the vertical support member is rotated to a non-cap engagement position.

17. A method of raising or lowering a cap, the method comprising the steps of:

a) providing a cap lifting apparatus comprising: a frame assembly including a base member, a vertical support member having an upper end and a lower end, and a horizontal support member having a distal end and a proximal end, the base member including an enlarged ring portion configured to receive a cap sub operatively attached to a wellhead and an elongated projected portion including a bore rotatably receiving the lower end of the vertical support member, the proximal end of the horizontal support member operatively connected to the upper end of the vertical support member; a hydraulic cylinder having an upper end and a lower end, the hydraulic cylinder including a hydraulic piston having a piston head contained within the hydraulic cylinder and a piston rod connected to the piston head and extending from the lower end of the hydraulic cylinder for operative attachment to a cap so that actuation of the hydraulic piston causes the cap to raise or lower about the cap sub; wherein the enlarged ring portion of the base member includes a first aperture configured to receive a first locking screw for operative attachment of the base member to the cap sub;

b) actuating the hydraulic piston to lower the cap onto the cap sub.

18. The method of claim 17, further comprising the steps of:

c) actuating the hydraulic piston to raise the cap from the cap sub;

d) rotating the vertical support member at least 90 degrees in a clockwise or counterclockwise direction.

19. The method of claim 18, further comprising the steps of:

e) rotating the vertical support member so that the hydraulic piston is in substantial axial alignment with the cap;

f) actuating the hydraulic piston to lower the cap onto the cap sub;

g) operatively affixing the cap to the cap sub.

* * * * *